US009777442B2

(12) United States Patent
Weiler et al.

(10) Patent No.: US 9,777,442 B2
(45) Date of Patent: Oct. 3, 2017

(54) SYSTEM AND METHOD OF APPLYING MATERIAL TO A SURFACE

(71) Applicant: Weiler, Inc., Knoxville, IA (US)

(72) Inventors: Patrick Weiler, Pella, IA (US); Tom Roth, Lerna, IL (US); Brett Huizer, Monroe, IA (US)

(73) Assignee: WEILER, INC., Knoxville, IA (US)

( * ) Notice: Subject to any disclaimer, the term of this patent is extended or adjusted under 35 U.S.C. 154(b) by 0 days.

(21) Appl. No.: 14/742,776

(22) Filed: Jun. 18, 2015

(65) Prior Publication Data

US 2016/0215458 A1 Jul. 28, 2016

Related U.S. Application Data

(63) Continuation-in-part of application No. 14/606,827, filed on Jan. 27, 2015.

(60) Provisional application No. 61/947,153, filed on Mar. 3, 2014.

(51) Int. Cl.

| | |
|---|---|
| ***E01C 19/00*** | (2006.01) |
| ***E01C 7/00*** | (2006.01) |
| ***E01C 19/08*** | (2006.01) |
| ***E01C 19/48*** | (2006.01) |
| ***E01C 19/10*** | (2006.01) |

(52) U.S. Cl.

CPC ..... *E01C 19/002* (2013.01); *E01C 7/00* (2013.01); *E01C 19/08* (2013.01); *E01C 19/1063* (2013.01); *E01C 19/48* (2013.01); *E01C 2301/04* (2013.01)

(58) Field of Classification Search

CPC ..... E01C 19/00; E01C 19/002; E01C 19/16; E01C 19/45; E01C 7/00

See application file for complete search history.

(56) References Cited

U.S. PATENT DOCUMENTS

| | | | | |
|---|---|---|---|---|
| 2,271,434 | A * | 1/1942 | Johnson | B28C 7/0486 414/21 |
| 4,534,674 | A * | 8/1985 | Cutler | E01C 23/07 404/101 |
| 5,015,120 | A * | 5/1991 | Brock | B60P 1/38 404/108 |
| 5,100,277 | A * | 3/1992 | Musil | E01C 19/48 404/108 |
| 5,234,128 | A * | 8/1993 | Hill | E01C 19/2005 222/52 |
| 5,752,783 | A * | 5/1998 | Malone | E01C 19/006 404/104 |
| 5,846,022 | A * | 12/1998 | Grundl | E01C 19/48 404/101 |
| 6,213,680 | B1 * | 4/2001 | Schaeffer | B28C 9/04 404/107 |
| 7,077,601 | B2 * | 7/2006 | Lloyd | E01C 23/065 180/209 |
| 2002/0182009 | A1 * | 12/2002 | Barnat | E01C 19/21 404/111 |

(Continued)

*Primary Examiner* — Abigail A Risic

(74) *Attorney, Agent, or Firm* — David M. Breiner; BrownWinick Law firm

(57) ABSTRACT

A system including a first feeder configured to transport asphalt, a second feeder configured to receive the asphalt from the first feeder, and a controller configured to control a speed of the first feeder and the second feeder in response to an input from an operator.

16 Claims, 11 Drawing Sheets

(56) References Cited

U.S. PATENT DOCUMENTS

| | | | | |
|---|---|---|---|---|
| 2003/0010600 | A1* | 1/2003 | Speers | B65G 41/005 198/300 |
| 2003/0194273 | A1* | 10/2003 | Lloyd | E01C 23/065 404/83 |
| 2003/0198122 | A1* | 10/2003 | Johnson | B28B 13/027 366/2 |
| 2006/0002762 | A1* | 1/2006 | Crampton | E01C 19/15 404/110 |
| 2008/0292398 | A1* | 11/2008 | Potts | E01C 19/48 404/83 |
| 2010/0236991 | A1* | 9/2010 | Hastings | C10G 1/04 208/390 |
| 2010/0326065 | A1* | 12/2010 | Permi | B07B 1/005 60/327 |
| 2011/0147481 | A1* | 6/2011 | Warchola | E01C 19/203 239/74 |
| 2011/0318102 | A1* | 12/2011 | Utterodt | E01C 19/48 404/72 |
| 2012/0234934 | A1* | 9/2012 | Score | E01C 19/203 239/7 |
| 2013/0076497 | A1* | 3/2013 | Sheidler | B62D 59/04 340/431 |
| 2013/0189032 | A1* | 7/2013 | Bellerose | E01C 23/065 404/75 |
| 2014/0099165 | A1* | 4/2014 | Smieja | E01C 19/48 404/72 |
| 2014/0116525 | A1* | 5/2014 | Bondeson | F16L 53/00 137/13 |
| 2014/0123875 | A1* | 5/2014 | Ackerman | C09D 195/00 106/284.01 |
| 2014/0286706 | A1* | 9/2014 | Klockner | B60D 1/62 404/90 |

* cited by examiner

SYSTEM AND METHOD OF APPLYING MATERIAL TO A SURFACE

CROSS-REFERENCE TO RELATED APPLICATIONS

The application is a continuation-in-part of U.S. patent application Ser. No. 14/606,827 which was filed with the United States Patent and Trademark application on Jan. 27, 2015 which claims priority to U.S. Provisional Patent Application No. 61/947,153 which was filed with the United States Patent and Trademark Office on Mar. 3, 2014, the entire contents of which are herein incorporated by reference.

BACKGROUND

1. Field

Example embodiments relate to systems and methods of applying a material, for example, asphalt, to a surface.

2. Description of the Related Art

FIG. 1A is a view of a system 5 used for applying asphalt to a road. As shown in FIG. 1A, the system 5 includes a dump truck 10, a material transfer vehicle 50, and a paver 90. In the conventional art, the material transfer vehicle 50 includes a hopper 55, a first feeder 60, a second feeder 65, and a third feeder 70. The hopper 55 is configured to receive asphalt from the dump truck 10 and the first feeder 60 is configured to move the asphalt to the second feeder 65. The second feeder 65 includes an auger system to mix the asphalt and feed the asphalt to the third feeder 70 which, in turn, is configured to move the asphalt to the paver 90.

FIG. 1B is a partial schematic view of the material transfer vehicle 50. As shown in FIG. 1B, the material transfer vehicle 50 includes a first electronically controlled hydrostatic pump configured to drive a first hydraulic drive motor which in turn is configured to drive the first feeder 60, a second electronically controlled hydrostatic pump configured to drive a second hydraulic drive motor which in turn is configured to drive the second feeder 65, and a third electronically controlled hydrostatic pump configured to drive a third hydraulic drive motor which in turn is configured to drive the third feeder 70. In the conventional art the first feeder 60 may be controlled by a user input whereas the second and third feeders 65 and 70 receive a fixed signal so that they operate at a relatively high speed.

In the system 5 of FIG. 1A the first feeder 60 includes a chain 72 driven by a sprocket which is driven by a hydraulic motor. FIG. 2, for example, is a partial view of the chain 72. The chain 72 resembles a belt with paddles and/or slats 75 used to move the asphalt 80 along the first feeder 60. Similarly, the third feeder 70 includes a chain which also resembles a belt with paddles and/or slats.

FIG. 3A is a view of another system 100 used for applying asphalt to a road. As shown in FIG. 3A, the system 100 includes a dump truck 110, a material transfer vehicle 150, and a paver 190. In this conventional system 100 the material transfer vehicle 150 includes a first hopper 155, a first feeder 160, a second hopper 157, a second feeder 165, and a third feeder 170. The first hopper 155 is configured to receive asphalt from the dump truck 110 and the first feeder 160 is configured to move the asphalt to the second hopper 157 where it is transferred, via the second feeder 165, to the third feeder 170. The third feeder 170, in turn, moves the asphalt to the paver 190. In this system 100, the first, second, and third feeders 160, 165, and 170 include chains driven by hydraulic motors. The chains, for example, resemble belts with paddles and/or slats as was previously described.

FIG. 3B is a partial schematic view of the material transfer vehicle 150. As shown in FIG. 3B, the material transfer vehicle 150 includes a first electronically controlled hydrostatic pump configured to drive a first hydraulic drive motor which in turn is configured to drive the first feeder 160, a second electronically controlled hydrostatic pump configured to drive a second hydraulic drive motor which in turn is configured to drive the second feeder 165, and a third electronically controlled hydrostatic pump configured to drive a third hydraulic drive motor which in turn is configured to drive the third feeder 170. In the conventional the first and second feeders 160 and 165 are controlled by user inputs and the third feeder 170 is configured to receive a fixed signal which causes it to operate at a relatively high speed.

In each of the above described systems 5 and 100, hydraulic motors are used to control the operations of the first feeders 60 and 160, the second feeders 65 and 165, and the third feeders 70 and 170. In general, the first, second, and third feeders 60 and 160, 65 and 165, and 70 and 170 are independently controlled. In normal operation, the second feeder 65 and the third feeders 70 and 170 are set to deliver asphalt at a relatively high rate regardless of the setting of the first feeders 60 and 160 or the second feeder 165. This manner of controlling the systems 5 and 100 prevents asphalt delivered from the first feeders 60 and 160 to the second feeders 65 and 165 (and then to the third feeders 70 and 170) from over-accumulating in the material transfer vehicle.

SUMMARY

The inventor has noted that while conventional paving systems do an adequate job of applying asphalt to the ground, the conventional systems suffer several drawbacks. First, because conventional systems generally operate certain feeders to deliver asphalt at a relatively high rate, the wear on these feeders is relatively high compared to the wear of feeders which may be operated at a lower rate. Second, because some feeders are generally set to deliver asphalt at a fairly high rate regardless of material volume, the asphalt moved by these feeders may cause the asphalt to unnecessarily segregate. Third, the inventor notes conventional transfer vehicles lack indicators indicating the level of asphalt that is present in the material transfer vehicles. As a consequence, the only way to determine a level of asphalt in a material transfer vehicle is to manually inspect the material transfer vehicle storage hopper from above. In view of the above problems, the inventor has set out to improve conventional systems and/or methods of applying asphalt to a surface. As a result, the inventor has developed a novel and nonobvious system and method of applying asphalt to surfaces. The invention, however, is not limited thereto, as the inventive concepts recited herein may be applied in other industries and technologies where materials are applied to surfaces. For example, the material may be, but is not limited to, concrete, sand, gravel, or some other material.

In accordance with example embodiments, a system may include a first feeder configured to transport asphalt, a second feeder configured to receive the asphalt from the first feeder, and a controller configured to control a speed of the first feeder and the second feeder in response to a single input from an operator.

BRIEF DESCRIPTION OF THE DRAWINGS

Example embodiments are described in detail below with reference to the attached drawing figures, wherein.

DETAILED DESCRIPTION

Figure 1A:
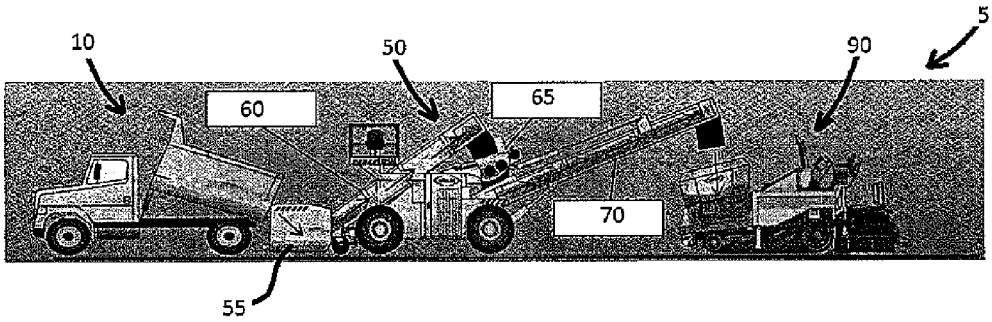
FIGS. 1A and 1B are views of a system in accordance with the conventional art.

Example embodiments will now be described more fully with reference to the accompanying drawings, in which example embodiments of the invention are shown. The invention may, however, be embodied in different faints and should not be construed as limited to the embodiments set forth herein. Rather, these embodiments are provided so that this disclosure will be thorough and complete, and will fully convey the scope of the invention to those skilled in the art. In the drawings, the sizes of components may be exaggerated for clarity.

It will be understood that when an element or layer is referred to as being "on," "connected to," or "coupled to" another element or layer, it can be directly on, connected to, or coupled to the other element or layer or intervening elements or layers that may be present. In contrast, when an element is referred to as being "directly on," "directly connected to," or "directly coupled to" another element or layer, there are no intervening elements or layers present. As used herein, the term "and/or" includes any and all combinations of one or more of the associated listed items.

It will be understood that, although the terms first, second, etc. may be used herein to describe various elements, components, regions, layers, and/or sections, these elements, components, regions, layers, and/or sections should not be limited by these terms. These terms are only used to distinguish one element, component, region, layer, and/or section from another elements, component, region, layer, and/or section. Thus, a first element component region, layer or section discussed below could be termed a second element, component, region, layer, or section without departing from the teachings of example embodiments.

Spatially relative terms, such as "beneath," "below," "lower," "above," "upper," and the like, may be used herein for ease of description to describe one element or feature's relationship to another element(s) or feature(s) as illustrated in the figures. It will be understood that the spatially relative terms are intended to encompass different orientations of the structure in use or operation in addition to the orientation depicted in the figures. For example, if the structure in the figures is turned over, elements described as "below" or "beneath" other elements or features would then be oriented "above" the other elements or features. Thus, the exemplary term "below" can encompass both an orientation of above and below. The structure may be otherwise oriented (rotated 90 degrees or at other orientations) and the spatially relative descriptors used herein interpreted accordingly.

Embodiments described herein will refer to plan views and/or cross-sectional views by way of ideal schematic views. Accordingly, the views may be modified depending on manufacturing technologies and/or tolerances. Therefore, example embodiments are not limited to those shown in the views, but include modifications in configurations formed on the basis of manufacturing process. Therefore, regions exemplified in the figures have schematic properties and shapes of regions shown in the figures exemplify specific shapes or regions of elements, and do not limit example embodiments.

The subject matter of example embodiments, as disclosed herein, is described with specificity to meet statutory requirements. However, the description itself is not intended to limit the scope of this patent. Rather, the inventors have contemplated that the claimed subject matter might also be embodied in other ways, to include different features or combinations of features similar to the ones described in this document, in conjunction with other technologies. Generally, example embodiments relate to systems and methods of applying a material, for example, asphalt, to a surface.

Figure 4:
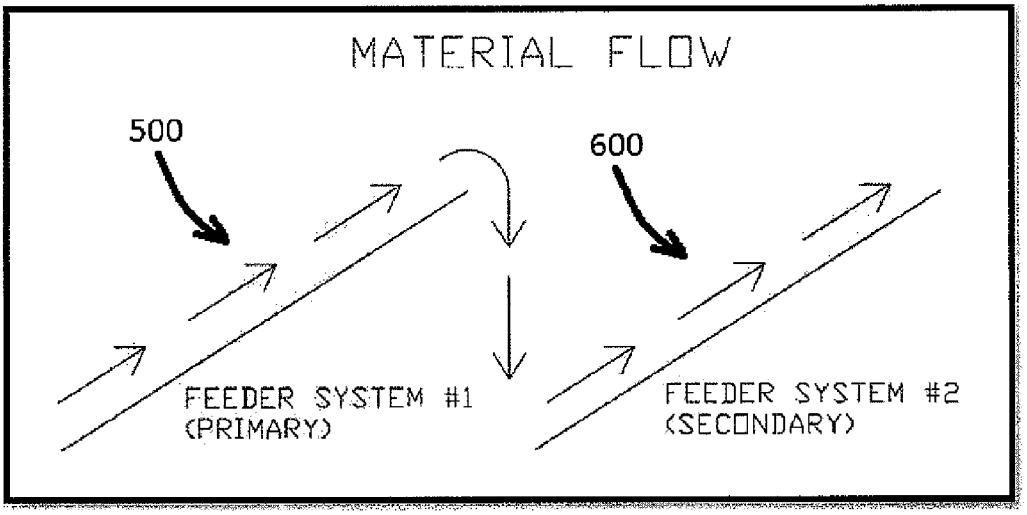
FIG. 4 is a view of a system in accordance with example embodiments.
Figure 5:
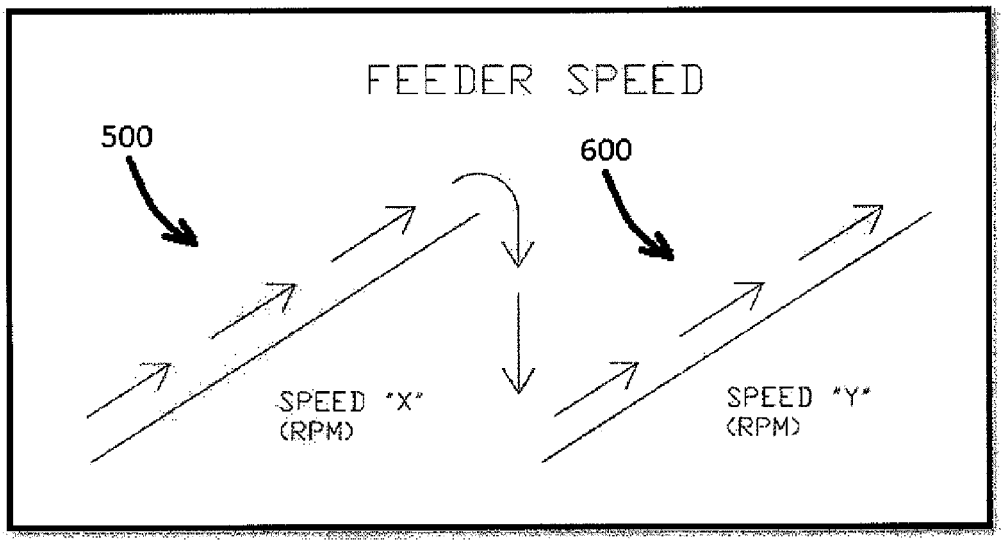
FIG. 5 is a view of a system in accordance with example embodiments.

FIG. 4 is an example of a system having a first feeder 500 and a second feeder 600 in accordance with example embodiments. In example embodiments the first and second feeders 500 and 600 may be associated with a paving system and may be configured to move asphalt. For example, the first and second feeders 500 and 600 may be associated with a material transfer vehicle.

In example embodiments the first and second feeders 500 and 600 may include chains that resemble belts with paddles as is well known in the art. For example, each of the first and second feeder systems 500 and 600 may include a chain supported by a plurality of rollers wherein one of the rollers is connected to a sprocket driven by a motor. In example embodiments, the first feeder 500 may be powered by a first motor and the second feeder 600 may be powered by a second motor. In example embodiments, the first and second motors may be, but are not required to be, hydraulic motors. For example, the first and second motors may be electric motors.

In example embodiments the first feeder 500 may include a chain of a first size and the second feeder 600 may include a chain of a second size. Thus, in example embodiments, the chains of the first and second feeder systems 500 and 600 may move different amounts of a material if they are operated at the same speed. For example, if the chain of the first feeder 500 has a width of four feet and the chain of the second feeder 600 has a width of two feet and both chains are operated at the same speed, then the first chain may move twice an amount of material with respect to an amount of material moved by the second chain over a same time period. Of course, if the second chain were operated at a speed which was twice the speed of the first chain then both chains may move a same amount of material over a given time period.

In example embodiments the chains of the first and second feeders 500 and 600 may be controlled simultaneously. As such, the first and second feeders 500 and 600 may be, but are not required to be, controlled so that they deliver a same amount of material over a same time period. For example, in example embodiments, a first motor configured to operate the first feeder 500 and a second motor configured to operate the second feeder 600 may be simultaneously controlled by a controller which may be configured to receive input from an operator or some other source, for example, a wireless transmitter or a sensor. In example embodiments the sensor may be configured to send a signal either directly or indirectly to the controller. The controller, for example, may be configured to control the first motor and the second motor based on the input from the operator or from a signal sent by a sensor, such that an amount of material moved by the first and second feeders 500 and 600 over a same time period may be the same despite differing belt sizes by simultaneously reducing and/or minimizing the speed at which the first and second motors operate. Furthermore, in example embodiments, each of the first and second feeders 500 and 600 may be controlled in accordance with single input provided by the operator or the other source. Though example embodiments illustrate a concept of controlling first and second feeders to move a same amount of material over a same time period, example embodiments are not limited thereto. For example, the second feeder may be controlled to move more material or less material than is being provided by the first feeder.

In example embodiments each of the first and second feeders 500 and 600 may be simultaneously controlled and may be simultaneously controlled by a single input. Thus, in example embodiments, if an operator decides to reduce an amount of material moved by the first feeder 500 the operator may input data to the controller to reduce a speed of the first motor. In example embodiments, the controller may further respond by controlling a speed at which the second motor operates to reduce a speed at which the second motor operates (thereby reducing a speed of the second feeder 600). This stands in stark contrast to conventional feeders of conventional paving systems wherein adjacent feeders are controlled independently of one another (or are not adjustable) and adjusting a speed of a first feeder does not change a speed of a second feeder.

In example embodiments the controller may be further configured to receive operating parameters of the first and second feeders 500 and 600. For example, in example embodiments the first and second feeders 500 and 600 may include sensors which measure a parameter such as, but not limited to, pressure, electrical current, or torque. For example, in the event the first and second motors of the first and second feeders 500 and 600 are hydraulic motors, the parameter may be associated with a pressure of a fluid entering the hydraulic motor. On the other hand, if the first and second motors are electrical motors then the parameter may be associated with electrical current flowing through the motors. As yet another example, the parameter may be torque exerted by the first and second motors operating the first and second feeders 500 and 600. By measuring the torque (or pressure or current) an overload on the system may be detected and the system may slow the first and second feeders 500 and 600 down to minimize wear or it may control the first and second motors to prevent overloading. For example, the controller may be a computer having a memory with a plurality of control parameters stored in a table. In example embodiments, the control parameters may, for example, be related to pressure or current or torque. For example, if torque exerted by the first motor exceeds a first value the controller may be configured to reduce a speed of the first motor and the second motor to prevent the first motor from overloading while still maintaining a consistent material flow through the system. On the other hand, if the torque is relatively low (for example, if no material is being moved) then the controller may shut off the first and second motors thereby conserving fuel and wear.

As indicated above, the controller of example embodiments may be configured to change speeds of the first feeder 500 and the second feeder 600. For example, in one example embodiment, the first and second feeders 500 and 600 may be controlled to operate at a first non-zero speed. In this particular nonlimiting example embodiment, an operator may provide a single input to the controller which either increases or decreases speeds of the first and second feeders 500 and 600 to a second nonzero speed. In the alternative, if the first and second feeders 500 and 600 initially operate at different nonzero speeds, the controller may (in response to the single input) change a speed of the first feeder 500 to another nonzero speed and change the speed of the second feeder 600 to another nonzero speed which may or may not be the same as the speed of the first feeder 500. This latter embodiment may be especially applicable in cases where the chains of the first and second feeders 500 and 600 have a different size. Although the above description indicates that a single input may be used to change speeds of the first and second feeders 500 and 600, the invention is not limited thereto. For example, in example embodiments the controller may be configured to adjust speeds of the first and second feeders 500 and 600 based on input from sensors associated with the first and second feeders 500 and 600 or input from sensors not directly associated with the first and second feeders 500 and 600. For example, in this latter embodiment the second feeder 600 may transport asphalt to a hopper of a paver. The hopper may include a sensor indicating how much asphalt is residing therein. In this case, the sensor in the hopper may send a signal which may be utilized by the controller to control the speeds of first and second feeders 500 and 600. For example, if the level of asphalt in the hopper is low the controller may increase the speeds of the first and second feeders 500 and 600. If the level of asphalt in the hopper is high the controller may increase the speeds of the first and second feeders 500 and 600.

Figure 6A:
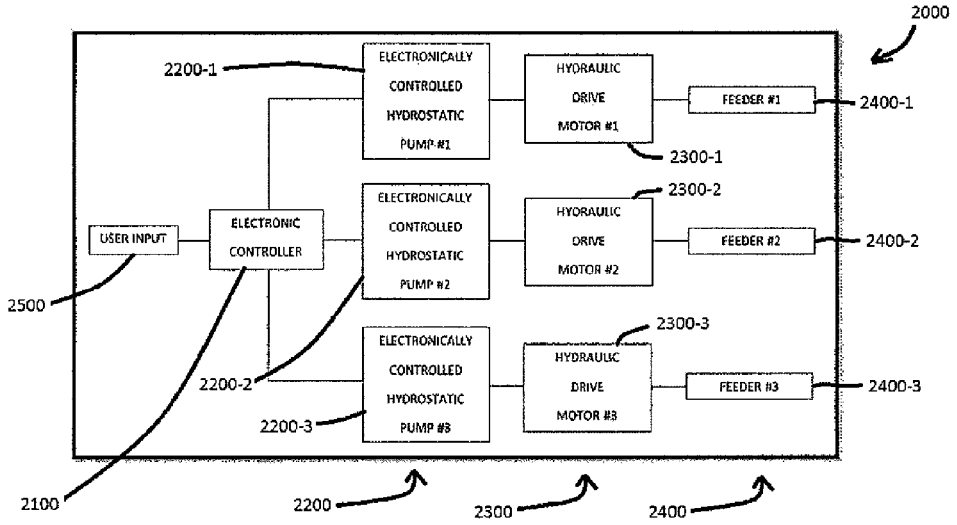
FIG. 6A is a view of a system in accordance with example embodiments.

FIG. 6A is a block diagram illustrating an implementation of the inventive concepts. In particular, FIG. 6A illustrates an example of a system 2000 configured to apply a material to a surface. In example embodiments the system 2000 includes a controller 2100, a plurality of electronically controlled hydrostatic pumps 2200, a plurality of hydraulic drive motors 2300, a plurality of feeders 2400, and an input module 2500. In example embodiments the controller 2100 may be an electronic controller, for example, a computer configured to control the plurality of hydrostatic pumps 2200. In example embodiments the system 2000 may be embodied in a material transfer vehicle which may be configured to transfer a material, for example, asphalt.

In example embodiments the plurality of electronically controlled hydrostatic pumps 2200 is illustrated as being comprised of a first hydrostatic pump 2200-1, a second hydrostatic pump 2200-2, and a third hydrostatic pump 2200-3. The number of hydrostatic pumps, however, is not intended to limit the invention. For example, in example embodiments the plurality of electronically controlled hydrostatic pumps 2200 may include only two hydrostatic pumps or more than three hydrostatic pumps. Similarly, plurality of hydraulic drive motors 2300 is illustrated as being comprised of three hydraulic motors, however, the plurality of hydraulic drive motors 2300 may include only two hydraulic drive motors or more than three hydraulic drive motors. Similar yet, the plurality of feeders 2400 is illustrated as being comprised of three feeders, however the plurality of feeders 2400 may include only two feeders or more than three feeders.

In example embodiments the input device 2500 may be configured, but is not required to be configured, to be controlled by an operator. For example, the input device 2500 may resemble a switch or a dial. In example embodiments the electronic controller 2100 may be configured to control the plurality of feeders 2400 based on the input from the input device 2500. For example, if an operator decides to increase the rate at which material is moved by the first feeder 2400-1 of the plurality of feeders 2400 the operator may use the input device 2500 to send a signal to the electronic controller 2100. In response, the electronic controller 2100 would control the first feeder 2400-1 by controlling the first electronically controlled hydrostatic pump 2200-1 and hydraulic drive motor 2300-1 to increase the speed of the first feeder 2400-1. Simultaneously (or nearly simultaneously) the electronic controller 2100 may also control the second and third feeders 2400-2 and 2400-3 to increase their speeds by controlling the second and third electronically controlled hydrostatic pumps 2200-2 and 2200-3 and the hydraulic motors 2300-2 and 2300-3 to ensure material is controllably moved through the system 2000. Thus, in example embodiments, a single input may adjust the speed of multiple feeders.

In addition to the input device 2500, the system 2000 may include various sensors that may be configured to measure various operational parameters associated with the plurality of hydraulic drive motors 2300. These parameters may be uploaded to the electronic controller 2100 so that the electronic controller 2100 may control the plurality of feeders 2400 based on the sensed parameters. For example, FIG. 6C illustrates the system 2000 which further includes pressure sensors 2500-1, 2500-2, and 2500-3. In example embodiments the pressure sensor 2500-1 may, for example, sense a pressure of fluid between the first electronically controlled hydrostatic pump 2200-1 and the first hydraulic drive motor 2300-1, the pressure sensor 2500-2 may, for example, sense a pressure of fluid between the second electronically controlled hydrostatic pump 2200-2 and the second hydraulic drive motor 2300-2, and the pressure sensor 2500-3 may, for example, sense a pressure of fluid between the third electronically controlled hydrostatic pump 2200-3 and the third hydraulic drive motor 2300-3. In example embodiments the pressure sensors 2500-1, 2500-2, and 2500-3 may communicate data to the electronic controller 2100 either through wires or wirelessly and the electronic controller 2100 may use this data to control the speeds of the first, second, and third feeders 2400-1, 2400-2, and 2400-3. For example, if a pressure sensed by any one of the three sensor 2500-1, 2500-2, and 2500-3 is above or below a first preset or predetermined value the electronic controller 2100 may simultaneously increase or decrease the speed of the first, second, and third feeders 2400-1, 2400-2, and 2400-3.

Figure 6B:
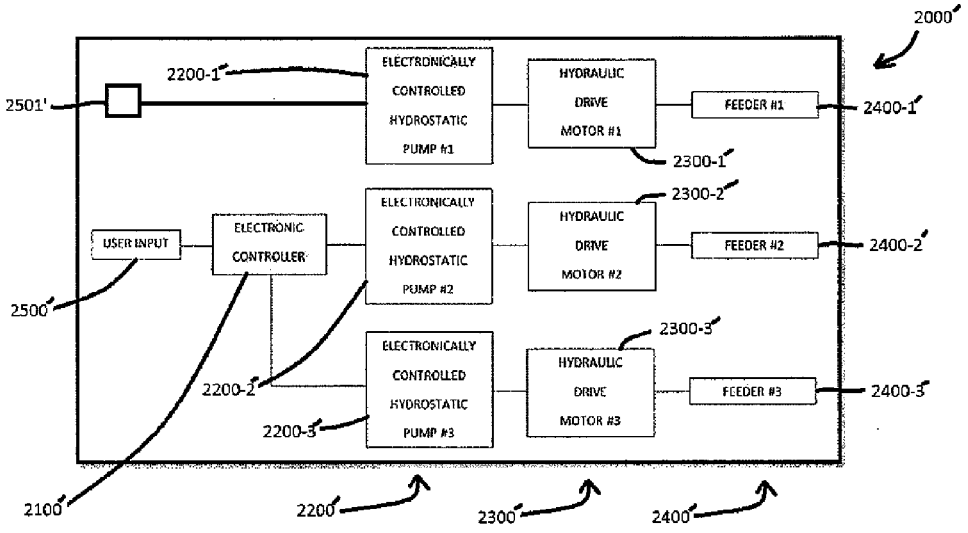
FIG. 6B is a view of a system in accordance with example embodiments.
Figure 6C:
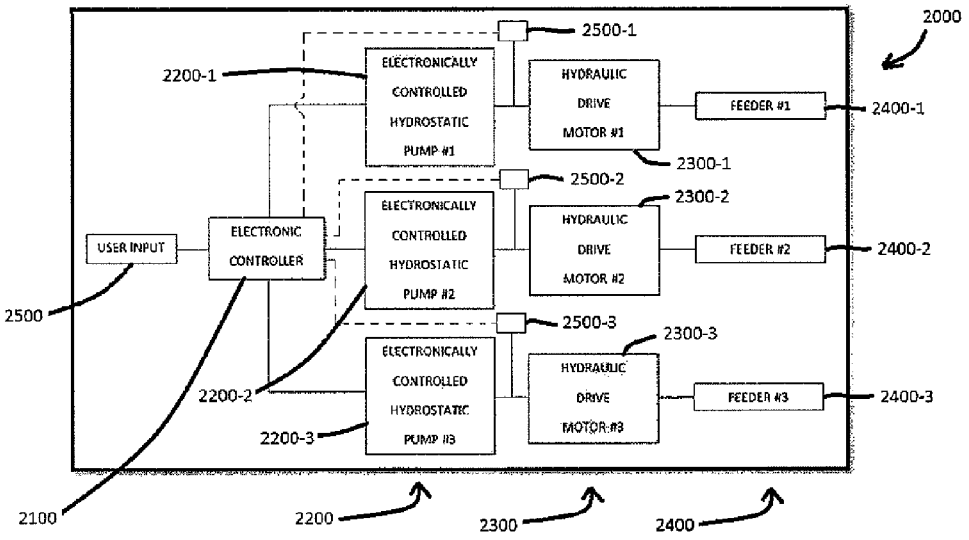
FIG. 6C is a view of a system in accordance with example embodiments.

FIG. 6B is a block diagram of another system 2000' in accordance with example embodiments. In example embodiments the system 2000' shares many features in common with the system 2000 of FIG. 6A. For example, in example embodiments, the system 2000' includes a controller 2100', a plurality of electronically controlled hydrostatic pumps 2200', a plurality of hydraulic drive motors 2300', a plurality of feeders 2400', and an input module 2500'. In example embodiments the controller 2100' may be an electronic controller, for example, a computer configured to control at least some of hydrostatic pumps of the plurality of hydrostatic pumps 2200'.

In example embodiments the plurality of electronically controlled hydrostatic pumps 2200' is illustrated as being comprised of a first hydrostatic pump 2200-1', a second hydrostatic pump 2200-2', and a third hydrostatic pump 2200-3'. The number of hydrostatic pumps, however, is not intended to limit the invention. For example, in example embodiments the plurality of electronically controlled hydrostatic pumps 2200' may include only two hydrostatic pumps or more than three hydrostatic pumps. Similarly, the plurality of hydraulic drive motors 2300' is illustrated as being comprised of three hydraulic motors, however, the plurality of hydraulic drive motors 2300' may include only two hydraulic drive motors or more than three hydraulic drive motors. Similar yet, the plurality of feeders 2400' is illustrated as being comprised of three feeders, however the plurality of feeders 2400' may include only two feeders or more than three feeders.

In example embodiments the input device 2500' may be configured, but is not required to be configured, to be controlled by an operator. For example, the input device 2500' may resemble a switch or a dial. In example embodiments the electronic controller 2100' may be configured to control at least some of the feeders of the plurality of feeders 2400' based on the input from the input device 2500'. For example, if an operator decides to increase the rate at which material is moved by the second feeder 2400-2' and third feeder 2400-3' of the plurality of feeders 2400' the operator may use the input device 2500' to send a signal to the electronic controller 2100'. In response, the electronic controller 2100' may control the second and third feeders 2400-2' and 2400-3' to increase their speeds by controlling the second and third electronically controlled hydrostatic pumps 2200-2' and 2200-3' and the hydraulic motors 2300-2' and 2300-3' to ensure material is controllably moved through the system 2000'.

Figure 6D:
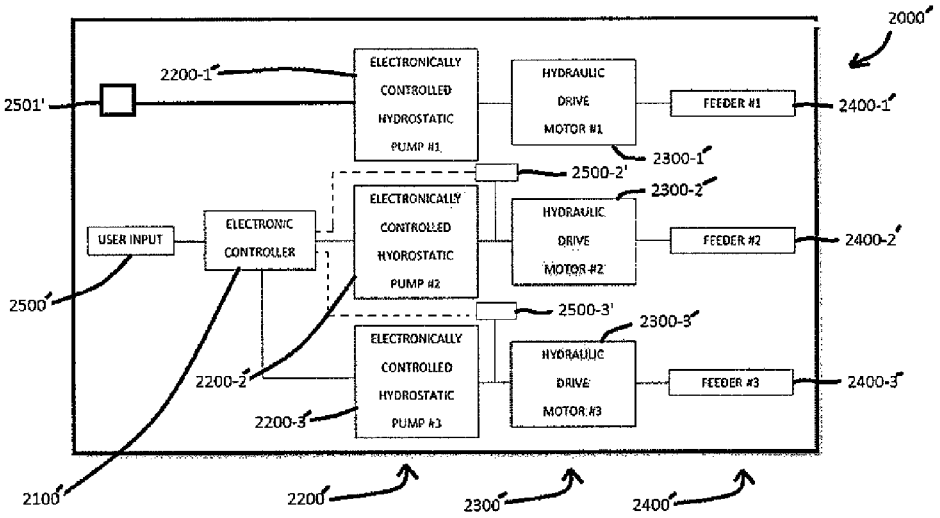
FIG. 6D is a view of a system in accordance with example embodiments.

In addition to the input device 2500', the system 2000' may include various sensors that may be configured to measure various operational parameters, for example, a fluid pressure associated with the plurality of hydraulic drive motors 2300'. These parameters may be uploaded to the electronic controller 2100' so that the electronic controller 2100' may control at least some of the feeders of the plurality of feeders 2400' based on the sensed parameters. For example, FIG. 6D illustrates the system 2000' further including pressure sensors 2500-2' and 2500-3'. In example embodiments the pressure sensor 2500-2' may, for example, sense a pressure of fluid between the second electronically controlled hydrostatic pump 2200-2' and the second hydraulic drive motor 2300-2', and the pressure sensor 2500-3' may, for example, sense a pressure of fluid between the third electronically controlled hydrostatic pump 2200-3' and the third hydraulic drive motor 2300-3'. In example embodiments the pressure sensors 2500-2' and 2500-3' may communicate data to the electronic controller 2100' either through wires or wirelessly and the electronic controller 2100' may use this data to control the speeds of the second and third speeders 2400-2' and 2400-3'. For example, if a pressure sensed by any one of the two sensors 2500-2' and 2500-3' is above or below a first preset or predetermined value the electronic controller 2100' may simultaneously increase or decrease the speed of the second and third feeders 2400-2' and 2400-3'.

In example embodiments the system 2000' is similar to the system 2000 in many respects. However, in example embodiments the controller 2100 is configured to simultaneously control all of the feeders of the plurality of feeders 2400 whereas the controller 2100' is configured to provide simultaneous control of only a few of the feeders of the plurality of feeders 2400'. Thus, in the system 2000', the speed of the first feeder 2400-1 may be controlled independently from the speeds of the second and third feeders 2400-2' and 2400-3'. In example embodiments, this may be accomplished by providing a separate input means 2501' which may be connected to a controller (not shown) which controls the first electronically controlled hydrostatic pump 2200-1' and hydraulic motor 2300-1'. This, however, is not meant to be a limiting feature of example embodiments. For example, rather than providing a separate input means 2501' and a separate controller the system 2000' may use the input module 2500' to send a signal to the controller 2100' which may be configured to operate the second and third feeders 2400-2' and 2400-3' independently of the first feeder 2400-1'. In the alternative, the separate input means 2501' may send a signal, either wirelessly or over wires, to the electronic controller 2100'. In this embodiment the electronic controller 2100' may be further configured to control the first electronically controlled hydrostatic pump 2200-1'. As such, in the embodiment of FIG. 6B, two user inputs may control the system 2000'. The first user input may be provided to the electronic controller 2100' to control a speed of the first feeder 2400-1' and the second input may be provided to the electronic controller 2100' to simultaneously control the second and third feeders 2400-2' and 2400-3'. It is understood in example embodiments that although FIG. 6B illustrates two input means 2500' and 2501' to provide input, the two input means 2500' and 2501' may be integrated as a single device configured to send two user inputs to the electronic controller 2100' and the electronic controller 2100' may be configured to control the first feeder 2400-1' based on a first user input and control the feeders 2400-2' and 2400-3' simultaneously based on a second input.

Figure 6E:
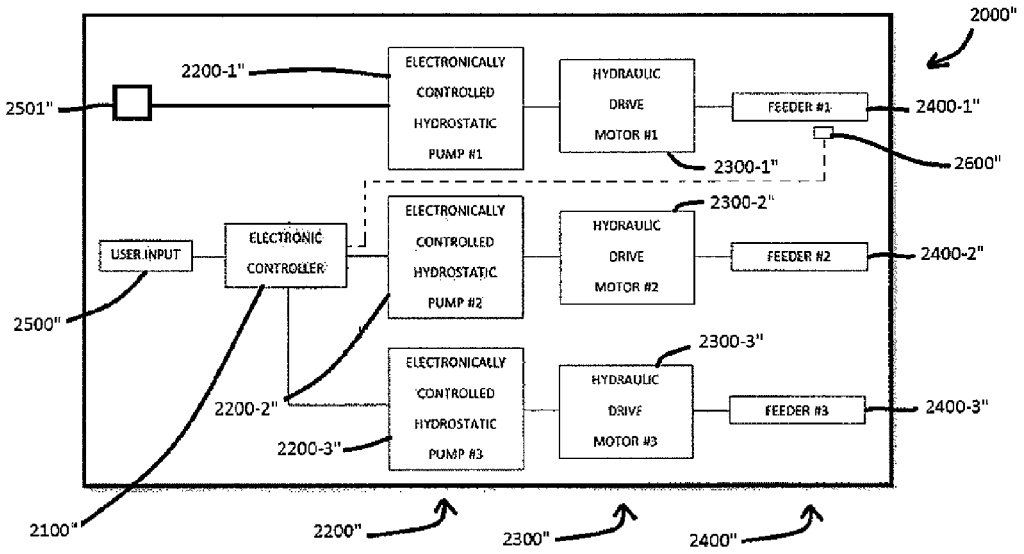
FIG. 6E is a view of a system in accordance with example embodiments.

FIG. 6E is a block diagram illustrating another implementation of the inventive concepts. In particular, FIG. 6E illustrates an example of a system 2000" configured to apply a material to a surface. In example embodiments the system 2000" includes a controller 2100", a plurality of electronically controlled hydrostatic pumps 2200", a plurality of hydraulic drive motors 2300", a plurality of feeders 2400", and an input module 2500". In example embodiments the controller 2100" may be an electronic controller, for example, a computer configured to control at least some of the plurality of hydrostatic pumps 2200". For example, in FIG. 6E the electronic controller 2100" is illustrated as being configured to control two of the three illustrated electronically controlled hydrostatic pumps. In example embodiments the system 2000" may be embodied in a material transfer vehicle which may be configured to transfer a material, for example, asphalt.

In example embodiments the plurality of electronically controlled hydrostatic pumps 2200" is illustrated as being comprised of a first hydrostatic pump 2200-1", a second hydrostatic pump 2200-2", and a third hydrostatic pump 2200-3". The number of hydrostatic pumps, however, is not intended to limit the invention. For example, in example embodiments the plurality of electronically controlled hydrostatic pumps 2200" may include only two hydrostatic pumps or more than three hydrostatic pumps. Similarly, plurality of hydraulic drive motors 2300" is illustrated as being comprised of three hydraulic motors, however, the plurality of hydraulic drive motors 2300" may include only two hydraulic drive motors or more than three hydraulic drive motors. Similar yet, the plurality of feeders 2400" is illustrated as being comprised of three feeders (2400-1", 2400-2", and 2400-3"), however the plurality of feeders 2400" may include only two feeders or more than three feeders.

In example embodiments the input device 2500" may be configured, but is not required to be configured, to be controlled by an operator. In addition (or in the alternative) the electronic controller 2100" may be configured to receive input from a sensor 2600" which may sense a parameter associated with one of the elements of the system 2000". For example, as shown in FIG. 6E, the sensor 2600" is shown as being positioned to sense a parameter associated with the first feeder 2400-1". For example, the sensor 2600" may be configured to sense how fast a chain of the first feeder 2400-1" is being operated and may send data related to the speed of the chain back to the electronic controller 2100" which may use this data to control the second and/or third feeders 2400-2" and 2400-3".

In example embodiments the sensor 2600" is shown as being configured to sense a parameter associated with the first feeder 2400-1", however, this is not intended to limit example embodiments. For example, rather than positioning the sensor 2600" to detect a parameter of the first feeder 2400-1", the sensor 2600" may be configured to sense a parameter associated with another component of the system 2000", for example, pressure associated with the first hydraulic drive motor 2300-1". In this latter embodiment the controller 2100" may use this sensed parameter to control the second and/or third feeders 2400-2 and 2400-3. Examples of the sensor 2600" may be, but are not required to be, a flow meters, sonic sensors, and amperage sensing devices.

In example embodiments the system 2000" may further include a user input 2500" to provide communication between a user and the electronic controller 2100". For example, the input device 2500" may resemble a switch or a dial. In example embodiments the electronic controller 2100" may be configured to control the plurality of feeders 2400 based on the input from the input device 2500". For example, if an operator decides to increase the rate at which material is moved by the second feeder 2400-2" and the third feeder 2400-3" of the plurality of feeders 2400" the operator may use the input device 2500" to send a signal to the electronic controller 2100". In response, the electronic controller 2100" would control the second feeder 2400-2" and the third feeder 2400-3" by controlling the second electronically controlled hydrostatic pump 2200-2" and the third hydrostatic pump 2200-3" to increase the speed of the second and third feeders 2400-2" and 2400-3".

In example embodiments, the system 2000" may further include a second user input 2501". Like the first user input 2500", the second user input 2501" may be, but is not required to be, a switch or a dial. In the nonlimiting example of FIG. 6E the second user input 2501" may be used to control the first electronically controlled hydrostatic pump 2200-1" which thereby controls the first hydraulic drive motor 2300-1" and the first feeder 2400-1". In example embodiments the electronic controller 2100" may be configured to control the second and third feeders 2400-1" and 2400-3" based on a parameter sensed by the sensor 2600". For example, if a user controls the first feeder 2400-1" via the second user input 2501" the electronic controller 2100" may control the second and third feeders 2400-1" and 2400-3" based on information sensed by the sensor 2600". In this manner, a user may directly control a speed of the first feeder 2400-1" and indirectly control the speeds of the second and third feeders 2400-2" and 2400-3" via the controller 2100" which receives input from the sensor 2600".

In example embodiments the electronic controllers 2100, 2100', and 2100" may be further configured to receive a signal and control the plurality of feeders 2400, 2400', and 2400" based on the signal. For example, in example embodiments the systems 2000, 2000', and 2000" may be embodied in a material transfer vehicle configured to transport asphalt to a hopper of a paver. In example embodiments, the hopper of the paver may include a sensor to detect an amount of asphalt in the hopper. In example embodiments the sensor may send a signal to the electronic controllers 2100, 2100', and 2100" either directly, or indirectly, and the electronic controllers 2100, 2100', and 2100" may control the plurality of feeders 2400, 2400', and 2400" based on the signal. For example, if the signal sent by the sensor in the hopper indicated the level of asphalt therein was too high the electronic controllers 2100, 2100', and 2100" may slow the speeds of the plurality of feeders 2400, 2400', and 2400". Conversely, if the signal sent by the sensor in the hopper indicated the level of asphalt therein was too low the electronic controllers 2100, 2100', and 2100" may increase the speeds of the plurality of feeders 2400, 2400', and 2400".

Figure 1B:
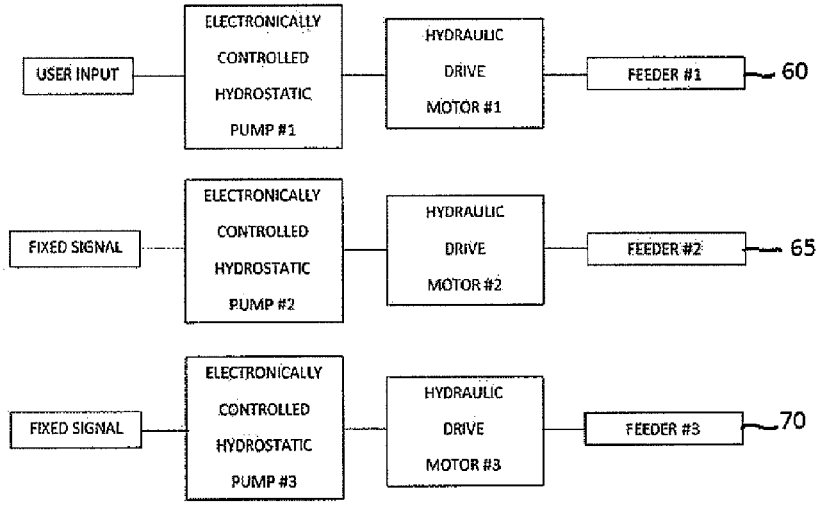
Figure 2:
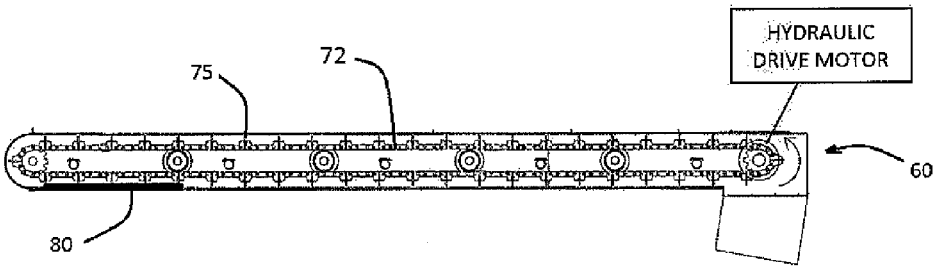
FIG. 2 is a partial view of a feeder in accordance with the conventional art.
Figure 7:
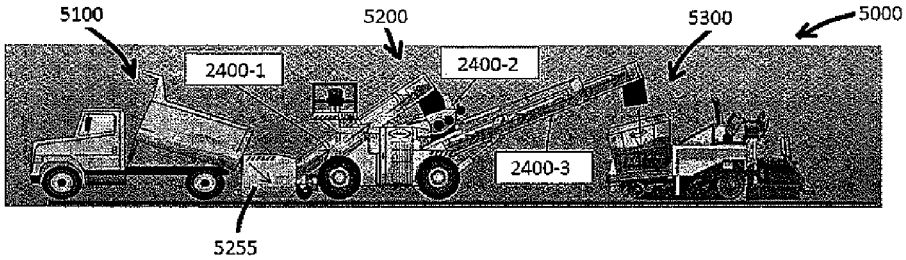
FIG. 7 is a view of a system in accordance with example embodiments.

FIG. 7 is a view of a paving system 5000 which implements the system 2000 of FIGS. 6A and or 6C. As shown in FIG. 7, the paving system 5000 may include a dump truck 5100, a material transfer vehicle 5200, and a paver 5300. The material transfer vehicle 5200 may be substantially identical to a material transfer vehicle marketed under Weiler E1250A which has been available since 2007. In example embodiments, the material transfer vehicle 5200 may include a hopper 5255, the first feeder 2400-1, the second feeder 2400-2, and the third feeder 2400-3. The hopper 5255 may be configured to receive asphalt from the dump truck 5100 and the first feeder 2400-1 may be configured to move the asphalt to the second feeder 2400-2. The second feeder 2400-2 may include an auger system to mix the asphalt and feed the asphalt to the third feeder 2400-3 which, in turn, is configured to move the asphalt to the paver 5300. As such, the system 5000 of example embodiments is similar to the conventional art illustrated in FIGS. 1A and 1B, however, unlike the conventional art, the system 5000 further includes the controller 2100 which may be configured to control the first electronically controlled hydrostatic pump 2200-1 and the first hydraulic motor 2300-1 which controls the first feeder 2400-1. Similarly, the controller 2100 may also be configured to control the second electronically controlled hydrostatic pump 2200-2 and the second hydraulic motor 2300-2 which controls the second feeder 2400-2. Similar yet, the controller 2100 may also be configured to control the third electronically controlled hydrostatic pump 2200-3 and the third hydraulic motor 2300-3 which controls the third feeder 2400-3. In this particular example, an operator may use the input device 2500 (which may be a single input device) to control a speed of the first feeder 2400-1 to increase or decrease the speed at which the first feeder 2400-1 operates. When the speed of the first feeder 2400-1 is either increased or decreased the controller 2100 automatically controls the second and third feeders 2400-2 and 2400-3 to increase or decrease their speeds as well. As such, the system 5000 is controlled such that asphalt (or another material) may move through the system 5000 in a controlled manner. Furthermore, the system is controlled such that a single input allows for simultaneous control of three feeders. Further yet the system 5000 may be configured so that the first feeder 2400-1, the second feeder 2400-2, and the third feeder 2400-3 are controlled so as to move a same amount of material despite having different belt sizes and/or different volumetric potential.

Figure 3A:
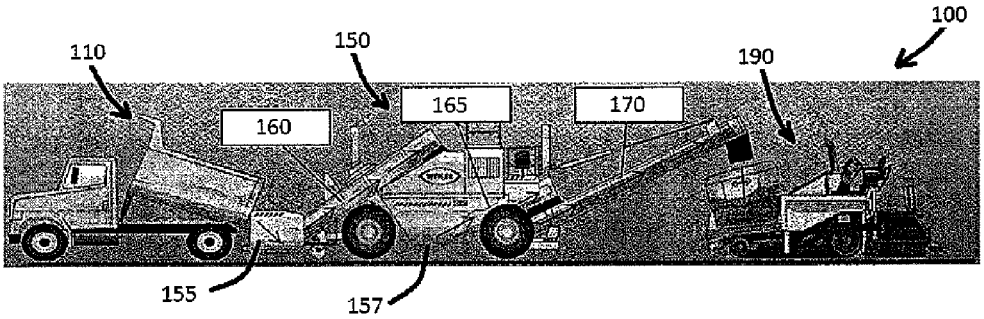
FIGS. 3A and 3B are views of another system in accordance with the conventional art.
Figure 3B:
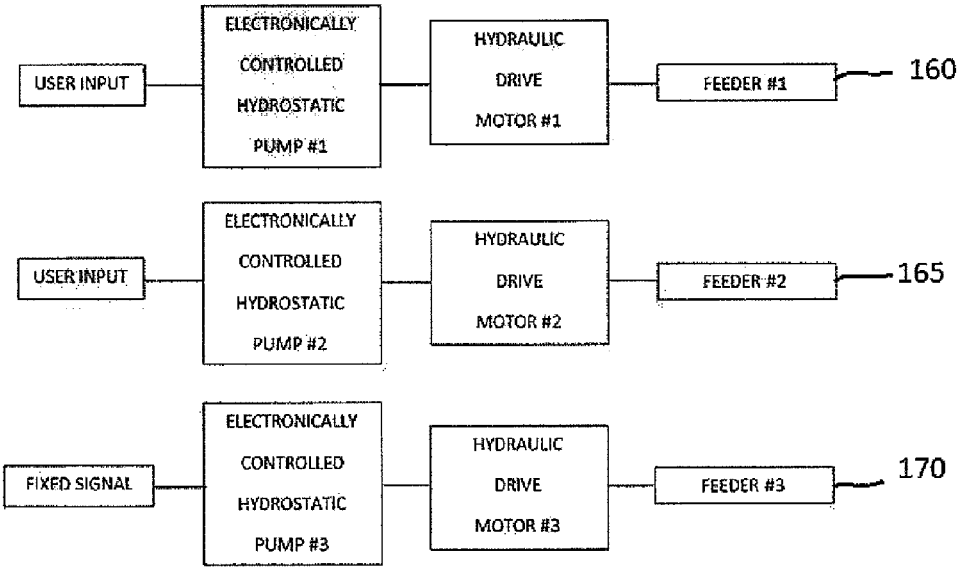
Figure 8:
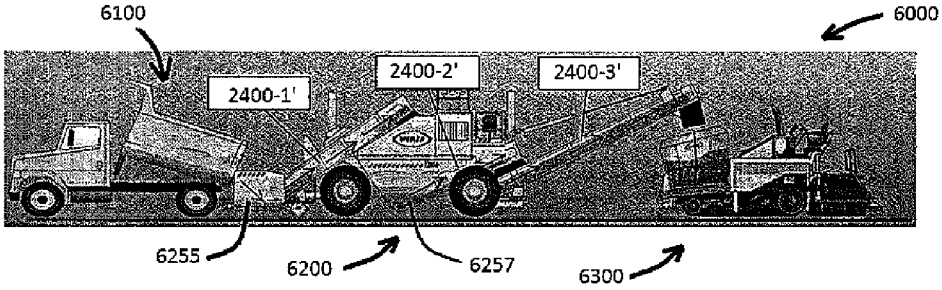
FIG. 8 is a view of a system in accordance with example embodiments.

FIG. 8 is a view of another paving system 6000 which implements the system 2000' of FIGS. 6B and/or 6D. As shown in FIG. 8, the paving system 6000 may include a dump truck 6100, a material transfer vehicle 6200, and a paver 6300. The material transfer vehicle 6200 may be substantially identical to a material transfer vehicle marketed under Weiler E2850 which has been available since 2010. In example embodiments, the material transfer vehicle 6200 may include a hopper 6255, the first feeder 2400-1', the second feeder 2400-2', and the third feeder 2400-3'. The hopper 6255 may be configured to receive asphalt from the dump truck 6100 and the first feeder 2400-1' may be configured to move the asphalt to the second hopper 6257. The second feeder 2400-2' may be configured to receive the asphalt from the second hopper 6257 and move the asphalt to the third feeder 2400-3' which, in turn, may be configured to move the asphalt to the paver 6300. As such, the system 6000 of example embodiments is similar to the conventional art illustrated in FIGS. 3A and 3B, however, unlike the conventional art, the system 6000 further includes the controller 2100' which may be configured to control the second electronically controlled hydrostatic pump 2200-2' and the second hydraulic motor 2300-2' which controls the second feeder 2400-2'. Similar yet, the controller 2100' may also be configured to control the third electronically controlled hydrostatic pump 2200-3' and the third hydraulic motor 2300-3' which controls the third feeder 2400-3'. In this particular example, an operator may use the input device 2500' to simultaneously control a speed of the second and third feeders 2400-2' and 2400-3' using a single input to increase or decrease their speeds to ensure a consistent flow of material. In this latter embodiment, the speed of the first feeder 2400-1' may be adjusted without having to adjust the speeds of the second and third feeders 2400-2' and 2400-3'. As such, the system 6000 is controlled such that asphalt (or another material) may move through the system 6000 in a controlled manner.

In example embodiments, the controllers 2100 and 2100' may be computers with software loaded thereon to enable control of their associated feeders. This software may have algorithms embedded therein which prevent a user from controlling various feeder speeds. For example, in some situations, for example, when the systems 2000 and 2000' are initially activated at a job site, the feeders 2400 and 2400' may be relatively cold. If the feeders 2400 and 2400' were operated at a slow rate when the feeders 2400 and 2400' are cold the asphalt may cool too quickly and cause some of the feeders 2400 and 2400' to clog up. In order to prevent this from happening, the controllers 2100 and 2100' may have algorithms built therein which cause certain feeders (for example, feeders 2400-2, 2400-3, and 2400-3') to operate at a fairly high speed for a certain time period, for example, fifteen minutes after start up, in order to ensure the feeders 2400 and 2400' are sufficiently warmed for efficient material transfer after which time the feeders 2400 and 2400' may be controlled via user input. In other words, the system may have set parameters and when the parameters are met, the system will activate and allow operators to have full control of the variable speed feeder system.

In accordance with example embodiments, a material transfer vehicle may contain two or more independently driven conveyor, chain, auger, belt, or feeder systems in series and the speeds of independently driven feeder systems may be adjusted simultaneously with one or more speed adjustment inputs. This stands in stark contrast to the conventional art wherein speeds of individual feeder systems in a series of feeders on a material transfer vehicle were adjusted independently or are not adjustable. Thus, in the systems according to example embodiments excess feeder system wear, excess fuel consumption, and an overall inefficiencies may be reduced. In example embodiments, speed/feed rate adjustment of multiple systems with one input may allow a machine to operate more efficiently without additional operator requirements. In addition, reducing the feeder chain speeds may allow asphalt to move through the machine feeder system slower with less material segregation. This may allow better maintenance of temperature of the material throughout the machine which in turn may also reduce segregation.

In example embodiments, a material transfer vehicle may be equipped with load (pressure, current, torque) monitoring equipment on the feeder system and/or the material transfer vehicle may be further equipped with a controller to control an engine or may vary the RPM of the independently driven feeders. By monitoring the load on the feeder system and/or engine it may be possible to increase or decrease feeder speed automatically in order to prevent machine stalling and excess fuel consumption. If a particular system on the machine becomes over-loaded, the controls system may slow down the feeders automatically in order to decrease load. As soon as the overloading condition subsides the system may increase the speed of the feeders automatically to return it to a normal use. This may increase efficient use of machine power while maximizing the machines loading capabilities. In example embodiments a speed of at least one of the feeders may be adjusted by changing the electrical current to the control solenoid on the variable displacement hydraulic pump or by decreasing engine speed or a combination there of.

Figure 9:
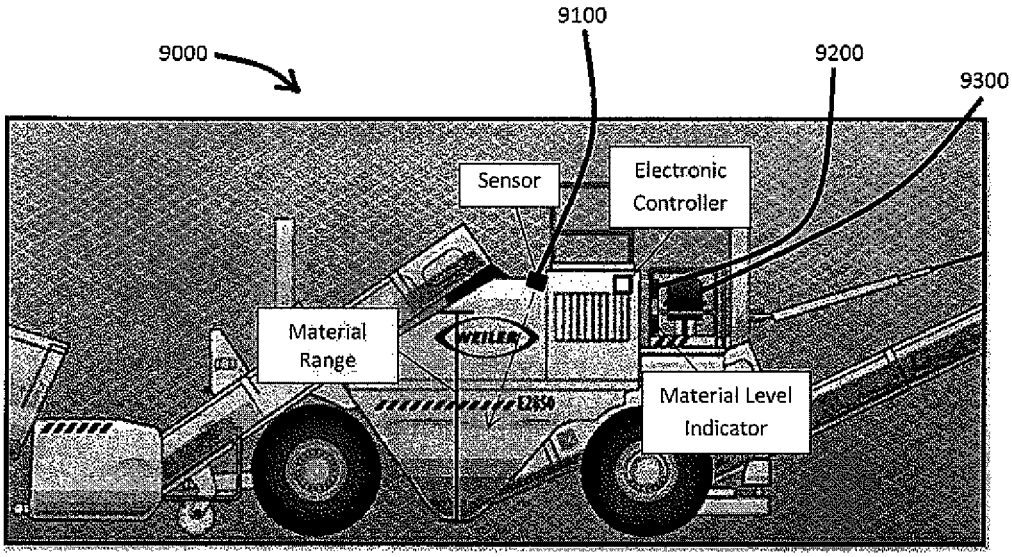
FIG. 9 is a view of a system in accordance with example embodiments.

FIG. 9 is a view of a material transfer vehicle 9000 in accordance with example embodiments. In FIG. 9, the material transfer vehicle 9000 is equipped with a sensor 9100 and a material level indicator 9200 which indicates a level of the material (for example, asphalt) that may be in a hopper of the material transfer vehicle 9000. In example embodiments, the sensor 9100 may be, but is not required to be, an ultrasonic sensor. However, many other kinds of sensors may be employed which are well known in the art. For example, the inventive concepts of this application include a use of a mechanical level gage to determine a level of material in the hopper. In example embodiments, the material level indicator 9200 may be coupled to the sensor 9100 such that a level of the material detected by the sensor 9100 may be displayed by the material level indicator 9200. In this particular nonlimiting example, the material level indicator 9200 includes three lights stacked on top of each other. When the level of the material detected is low only the bottom most light may be activated. When a level of asphalt detected indicates the hopper is approximately half full, the bottom two lights may be activated. When the hopper which is holding the asphalt is full all three lights may be turned on.

In example embodiments, the sensor 9100 may be configured to wirelessly transmit a signal to the electronic controller 2100. For example, in example embodiments, if the hopper of the transfer device 9000 is detected as being full, the controller may be configured to shut off the first feeder to prevent further asphalt from being loaded into the material transfer vehicle 9000. Example embodiments, however, are not limited to systems which include wireless transmission of data. For example, rather than transmitting data wirelessly, data may be communicated over a wire which may be installed on the equipment.

In addition to the above, example embodiments also allow for a system that uses the sensed data to determine an amount of weight of asphalt that is stored in the material transfer vehicle 9000. In this particular nonlimiting example, the sensor may send data to the controller 2100 which may be configured to use the sensed data to determine a weight of the material in the material transfer vehicle 9000. In example embodiments, the controller 2100 may be configured to shut down the first feeder in the event a weight limit associated with the material transfer vehicle 9000 is exceeded (or nearly exceeded) to prevent the material transfer vehicle 9000 from being overloaded with asphalt.

In example embodiments, the sensor 9100 may be used to determine the amount of asphalt inside of the main asphalt storage hopper on a material transfer vehicle 9000. The signal from the sensor 9100 may be converted to an output which is displayed as visible lights external to the machine. These indicator lights may act as a gauge that allows the operator and other workers around the machine to see a full range (empty to full) of material inside the storage hopper. This may also help prevent a material transfer vehicle from accepting too much material. For example, Applicant notes that many conventional sites have weight and/or ground pressure limitations. Thus, by determining how much asphalt is contained in a hopper of a material transfer vehicle, the inventive systems allow for a more accurate determination of vehicle weight, when loaded, to avoid exceeding the aforementioned limitations. This may also be accomplished by incorporating various load cells or sensors in the material transfer vehicle in order to measure how much material is in the hopper of the material transfer vehicle.

Previously, an operator on an operator platform 9300 was the only individual on the jobsite that would be able to monitor the amount of material inside the storage hopper. The only way the operator would know the level of material was to uncover the hopper and physically look inside. The level indicator lights allow the storage hopper level to be viewed in any condition (night or day) by anyone on the jobsite while leaving the hopper fully sealed. With the hopper sealed the asphalt temperature is maintained and steam/fumes are kept away from the operator.

Example embodiments provide several advantages over the prior art. For example, in example embodiments material height may be visible to an entire crew and/or other machine operators that may be on a ground level, heat retention of asphalt may be conserved, steam/fumes may be retained leading to increased job efficiency.

Also, as explained above, by sensing the level of material inside of the storage hopper, another option would be to convert the level of material into a weight unit. Weight of the material transfer vehicle is vital on many jobsites to prevent damage to the surface that the machine is driving on. Through the use of weight monitoring and feeder control the maximum weight of material that is contained inside the storage hopper may be controlled. If a maximum weight limit is set, a feeder that is filling the storage hopper when the limit is met may be shut off.

In addition, the control systems of example embodiments may greatly improve management and planning. Normally when asphalt is applied to a road it is done so with a fleet of dump trucks which bring asphalt to the material transfer vehicles. In example embodiments, the speed of the feeders of the material transfer vehicles may be adjusted to better match the rate at which the dump trucks are bringing asphalt to the material transfer vehicles. For example, if the rate at which the dump trucks are bringing asphalt to the material transfer vehicles is relatively low, an operator of the material transfer vehicles may simultaneously slow down at least some of the feeders to prevent their wear and tear and conserve fuel.

Also, an important aspect of many jobs is a requirement that the level material in the hopper cannot be below a certain percentage from full; this is to prevent asphalt segregation. Through the use of the level/weight monitoring a level minimum may be set that would not allow material within the hopper to drop below a set parameter. In addition, if the system is running without material (load) for a certain amount of time the feeders may be turned off without operator input to prevent excess wear on components.

Figure 10:
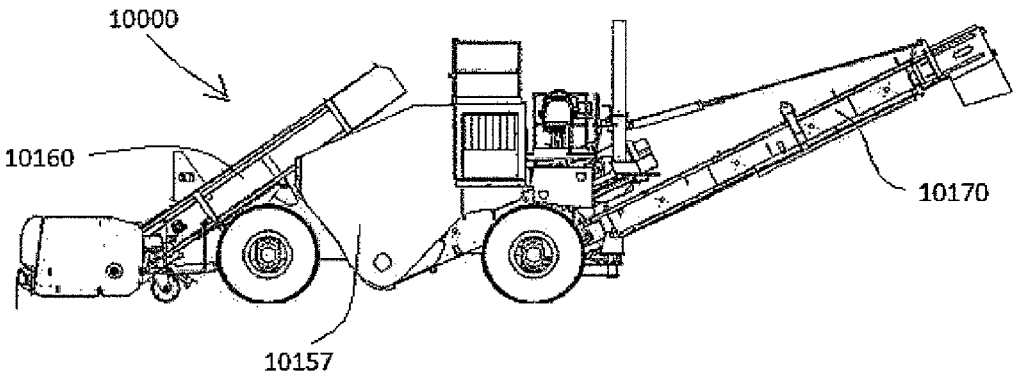
FIG. 10 is a view of a system in accordance with example embodiments.

FIG. 10 is a view of a system 10000 in accordance with example embodiments. In example embodiments, the system 10000 may include a first feeder 10160 configured to move a material, for example, asphalt, to a hopper 10157, and a second feeder configured to move the asphalt to a third feeder 10170 which may transfer the asphalt to a paver. In example embodiments, the system 10000 may resemble the Weiler E2850 material transfer vehicle modified as described above so that a single input may modify speeds of more than one feeder. However, the system 10000 may further include devices to quantify how much material may be present in the hopper 10157. The devices, for example, may include a distance sensor 10100 (for example, an ultrasonic sensor) an inclination sensor 10200, a parameter sensor 10300, a material level indicator 10400, and a controller 10500 configured to control the material level indicator 10400 based on data obtained from at least one of the distance sensor 10100, the inclination sensor 10200, and the parameter sensor 10300.

Figure 11:
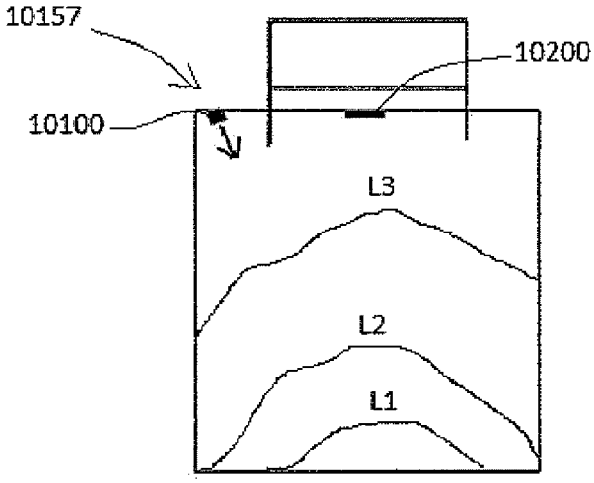
FIG. 11 is a partial view of a hopper with a level sensor and a proximity sensor in accordance with example embodiments.

In example embodiments, the material level indicator 10400 may, like the material level indicator 9200, indicate how much material is in the hopper 10157. In example embodiments, the material level indicator 10400 may be comprised of external lights which may function as an indicator as to how full the hopper 10157 is. In example embodiments, the material level indicator 10400 may be external to the hopper 10157 and may be easily viewed by persons on the ground. FIG. 11 is a cross section view of the hopper being filled with the material over time. For example, L1 indicates a material level in the hopper 10157 at a first time, L2 indicates a material level in the hopper 10157 at a later time and L3 indicates a material level in the hopper 10157 at yet a later time. As such, FIG. 11 illustrates the hopper being filled with a material over a time period. In FIG. 11 the distance sensor 10100 is arranged to detect the material. As such, the distance sensor 10100 may provide data indicating how full the hopper 10157 is. When the distance sensor 10100 detects that the material is relatively close to the sensor 10100 this information may infer the hopper 10157 is relatively full.

Figure 12:
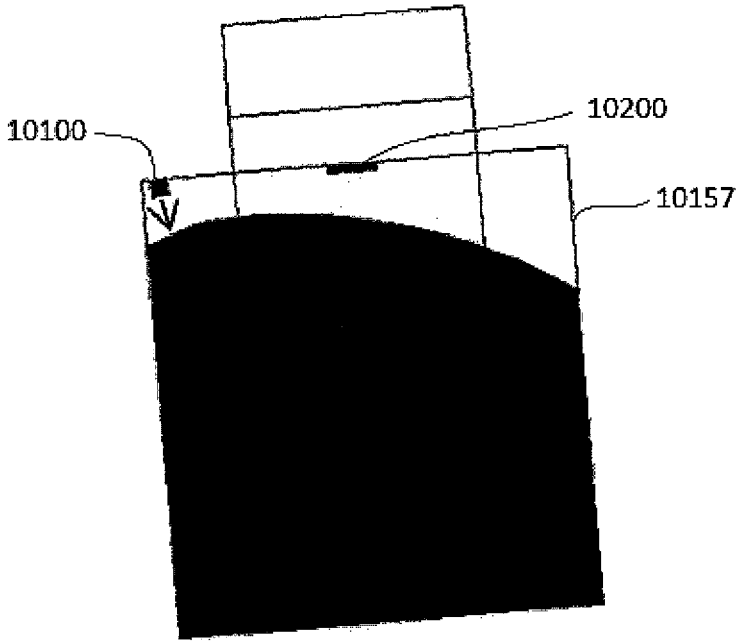
FIG. 12 is a partial view of a hopper with a material inside in accordance with example embodiments.
Figure 13:
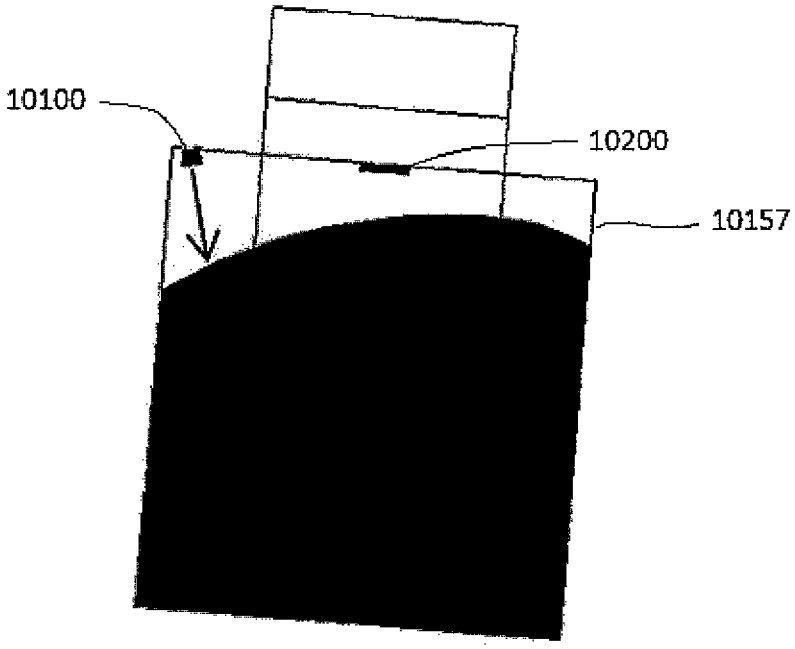
FIG. 13 is a partial view of a hopper with a material inside in accordance with example embodiments.

Applicant has discovered that while the distance information from the distance sensor 10100 may be relatively valuable in and of itself, that the distance information alone may not be an accurate predictor as to how full a hopper 10157 is. For example, if the system 10100 is inclined in a first direction the material filling the hopper 10157 may not have the substantially symmetric pattern illustrated in FIG. 11, rather, it might have an asymmetric pattern as shown in FIG. 12. Furthermore, if the system 10000 were inclined in a second direction, the material filling the hopper 10157 may have a different asymmetric pattern as shown in FIG. 13. In fact, the degree of asymmetry may be dependent on the amount the system 10000 is inclined. Thus, the information from the distance sensor 10100 alone may not provide an accurate picture as to how much material is in the hopper 10157.

To compensate for inclination, example embodiments may additionally include the inclination sensor 10200. The inclination sensor 10200 may measure not only a front to back inclination of the system 10000, but a left-to-right inclination as well. Furthermore, placement of the inclination sensor 10200 may be variable. For example, in one embodiment, the inclination sensor 10200 may be placed in the environment of the hopper 10157 and next to the distance sensor 10100. In another embodiment, the inclination sensor 10200 may be placed out of or away from the hopper 10157 in a controlled area, such as a frame that may be associated with the system 10000. Thus, the inclination sensor 10200 may be placed in an area away from the hopper 10157 and thus not be exposed to heat, debris, and other harmful elements that may be present in the hopper 10157. When the data from the inclination sensor 10200 is combined with the data from the distance sensor 10100, the combination of data may present a more accurate picture as to how full the hopper 10157 is compared to a system which only includes a distance sensor 10100. Also, although the embodiments thus far have described only a single distance sensor 10100 and a single inclination sensor 10200, example embodiments may also include systems with multiple distance sensors 10100 and multiple inclination sensors 10200.

Figure 14:
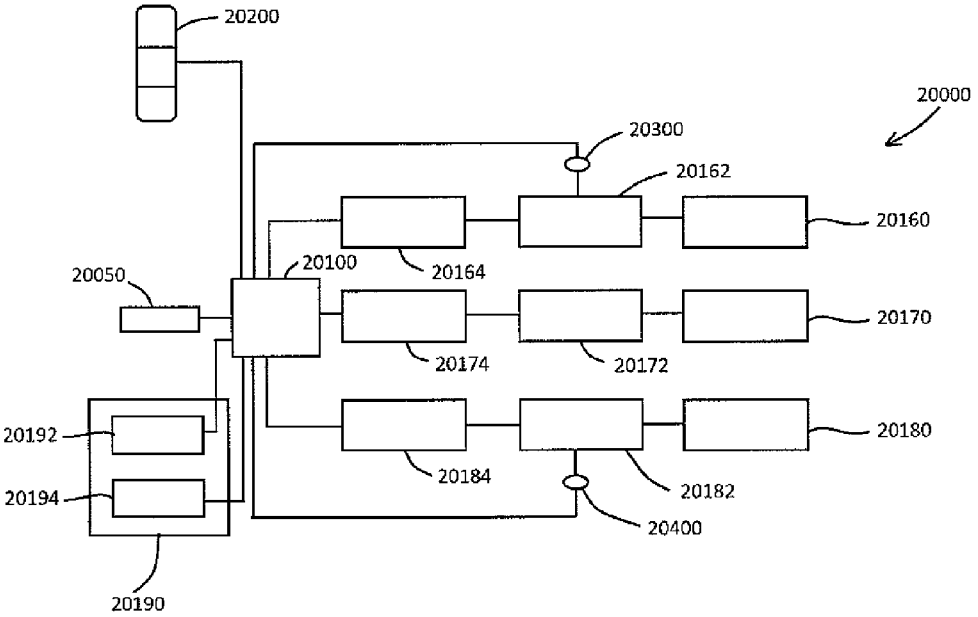
FIG. 14 is a view of a system in accordance with example embodiments.

FIG. 14 is a view of a system 20000 in accordance with example embodiments. In example embodiments the system 20000 may be implemented as a material transfer vehicle which may be similar to the Weiler E2850 material transfer vehicle modified as described above so that a single input may modify speeds of more than one feeder. Example embodiments, however, are not limited thereto as the system 20000 may be implemented in a manner similar to other types of material transfer vehicles such as, but not limited to, the Weiler E1250A.

Figure 15:
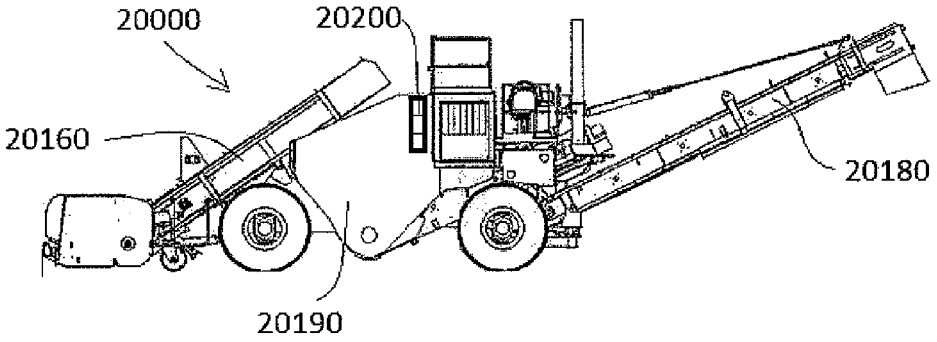
FIG. 15 is a view of a material transfer vehicle in accordance with example embodiments.

In example embodiments, the system 20000 may include a plurality of feeders configured to move a material, for example, asphalt, through the system 20000. In example embodiments, the system 20000 may further include at least one hopper 20190 to receive and temporarily hold the material. In the nonlimiting example embodiment of FIG. 14, the plurality of feeders is comprised of a first feeder 20160, a second feeder 20170, and a third feeder 20180, however, it is clear the inventive concepts cover systems having only two feeders or more than three feeders. In example embodiments the first feeder 20160 may be configured to move a material, for example, asphalt, to the hopper 20190, the second feeder 20170 may be configured to move the asphalt in the hopper 20190 to the third feeder 20180, and the third feeder 20180 may be configured to transfer the asphalt to a paver. When embodied as a material transfer vehicle the system may resemble that of FIG. 15.

In example embodiments, the system 20000 may include a controller 20100 which may be configured to control each of the feeders 20160, 20170, and 20180. For example, in example embodiments, the controller 20100 may be configured to receive input from an input device 20050 and may control operation of each of the feeders 20160, 20170, and 20180 based on the input from the input device 20050. In another embodiment, the controller 20100 may be configured to execute various algorithms to control each of the feeders 20160, 20170, and 20180 in accordance with feedback received from various sensors. In example embodiments the input device 20050 may be substantially the same as the user inputs 2500, 2500', and 2500" thus, a detailed description thereof is omitted for the sake of brevity. In example embodiments the controller 20100 may be a computer. The computer 20100 may have a memory chip, for example, a ROM chip, having various algorithms recorded therein to allow the computer 20100 to control the feeders 20160, 20170, and 20180.

In example embodiments, the system 20000 may further include devices which may provide data to the controller 20100. In some embodiments, the data may allow for the controller 20100 to quantify an amount of material which may be present in the hopper 20190. The devices, for example, may include a distance sensor 20192 (for example, an ultrasonic sensor), an inclination sensor 20194, a first parameter sensor 20300, and a second parameter sensor 20400. In example embodiments, each of the distance sensor 20192, the inclination sensor 20194, the first parameter sensor 20300, and the second parameter sensor 20400 may send data to the controller 20100 and the controller 20100 may use this data to determine how much material is present in the hopper 20190.

In example embodiments, an amount of material in the hopper 20190 may be determined using data provided by the distance sensor 20192 and the inclination sensor 20194. As previously described, the distance sensor 20192 may be provided in the hopper 20190 and may be used to determine, at least in part, how much material is in the hopper 20190. For example, material flowing in the hopper 20190 may form a pattern so that as material is added to the hopper 20190 material piles up and approaches the distance sensor 20192. A user may then use this data to predict how full the hopper 20190 is.

The inventors have contemplated that a pattern of material in a hopper 20190 may be affected in the event the hopper 20190 is inclined. To account for inclination, the inventors have included the inclination sensor 20194 to determine an inclination of the hopper 20190. In cases where the hopper 20190 is inclined, the inclination sensor 20194, which may or may not be in the hopper 20190, may provide data as to whether the hopper 20190 is inclined and to what degree. Furthermore, the inclination sensor 20194 may be configured to sense inclination about two separate axes. For example, the inclination sensor 20194 may be configured to sense whether or not, and to what degree, the hopper 20190 in inclined forward-to-backward and/or side-to-side.

In example embodiments, system 20000 may further include a material level indicator 20200 (an example of visual indicator) which may, like the material level indicator 9200, indicate how much material is in the hopper 20190. In example embodiments, the material level indicator 20200, for example, may be comprised of external lights which may function as an indicator as to how full the hopper 20190 is. The inventors are aware of conventional material transfer vehicles having a control panel arranged in an operator station. The inventors are also aware that some of these control panels include lights which may indicate an amount of material in the hopper 20190. However, these lights are generally not observable by ground personnel and thus do not constitute a material level indicator as defined in this application.

In example embodiments, the material level indicator 20400 may be external to the hopper 20190 and may be easily viewed by persons on the ground (an example of ground based personnel). In one nonlimiting example embodiment, the material level indicator 20400 includes multiple lights and the number of lights activated may correspond to how full the hopper 20190 is. For example, in one embodiment the material level indicator 20400 may be comprised of three vertically stacked lights. In the event the hopper 20190 is only filled to a quarter of its capacity only the lowest most light may be activated by the controller 20100. In the event the hopper 20190 is filled between a quarter of its capacity and three quarters of its capacity only the bottom two lights may be activated. However, if the hopper 20190 is filled at or beyond 75% of its total capacity, all three lights maybe activated.

In example embodiments, the controller 20100 may control the material level indicator 20400 based on input from the distance sensor 20192 and the inclination sensor 20194. For example, the controller 20100 may be configured to calculate how full the hopper 20190 is based on input from the distance sensor 20192 and the inclination sensor 20194 and then control the material level indicator 20400 based on how full the hopper is.

The inventors have discovered that some conventional distance sensors used in relatively hot steamy environments, for example, a hopper of a material transfer vehicle, may send a false signal to the controller 20100. To correct for this potential error, the inventors have developed another sensing system which may be used in conjunction with, or in lieu of, the distance sensor 20192 and the inclination sensor 20194. For example, in this latter embodiment parameter sensing devices may be placed around various elements of the system 20000 to sense parameters that may be directly or indirectly affected by material in the hopper 20190. For example, in one embodiment, the first feeder 20160, the second feeder 20170, and the third feeder 20180 are driven by a first hydraulic motor 20162, a second hydraulic motor 20172, and a third hydraulic motor 20182 which in turn are controlled by a first electronically controlled hydrostatic pump 2164, a second electronically controlled hydrostatic pump 20174, and a third electronically controlled hydrostatic pump 20184. In example embodiment, each of the first electronically controlled hydrostatic pump 20164, the second electronically controlled hydrostatic pump 20174, and the third electronically controlled hydrostatic pump 20184 may be controlled by the controller 20100. Thus, the controller 20100 may be configured to control each of the first, second and third feeders 20160, 20170, and 20180. In this particular nonlimiting example, a first parameter sensing device 20300 may sense a parameter associated with the first hydraulic motor 2162 and a second parameter sensing device 20400 may be provided to sense a parameter associated with the third hydraulic motor 20182. For example, the parameters sensed by the first and second parameter sensing devices 20300 and 20400 may be pressure associated with the first hydraulic motor 20162 and the third hydraulic motor 20182. Example embodiments, however, are not limited to systems which include hydraulic motors. For example, in another embodiment, each of the first, second, and third feeders 20160, 20170, and 20180 may be driven by electric motors and the first parameter sensing device 20300 may be configured to sense a parameter of a motor driving the first feeder 20160 and the second parameter sensing device 20400 may be configured to sense a parameter of the motor driving the third feeder 20180. In this latter embodiment, the parameter may be electric current drawn by the motors.

In example embodiments, each of the first and second parameter sensing devices 20300 and 20400 may send a signal to the controller 20100 and these signals may be associated with parameters sensed by the first and second parameter sensing devices. For example, in one embodiment, the first parameter sensing device 20300 may sense a pressure associated with the first hydraulic motor 20162 and may send a signal bearing information about the sensed pressure. Similarly, the second parameter sensing device 20400 may sense a pressure associated with the third hydraulic motor 20182 and may send a signal bearing information about the sensed pressure. In example embodiments, the first and second parameter sensing devices 20300 and 20400 may send the signal to the controller 20100 either by wire or wirelessly, or a combination thereof.

In example embodiments, the controller 20100 may control the first, second, and third feeders 20160, 21170, and 20180 in accordance with information received from the first and second parameter sensing devices 20300 and 20400. For example, in the event the first feeder 20160 is being utilized to transfer a material to the hopper 20190, the pressure associated with the first motor 20162 may be relatively high. In the event the first feeder 20160 is not transferring a material to the hopper 20190, the pressure associated with the first motor 20162 may be relatively low. Thus, the controller 20100 may know whether or not, or how much, material is being transferred into the hopper 20190 by the first feeder 20160 based on the parameter sensed by the first parameter sensing device 20300. Similarly, in the event the third feeder 20180 is being utilized to transfer a material out of the hopper 20190, the pressure associated with the third motor 20182 may be relatively high. In the event the third feeder 20180 is not transferring a material out of the hopper 20190, the pressure associated with the third motor 20182 may be relatively low. Thus, the controller 20100 may know whether or not, or how much, material is being transferred out of the hopper 20190 by the third feeder 20180 based on the parameter sensed by the second parameter sensing device 20400.

In example embodiments the second parameter sensor 20400 may serve as an integrity check on the distance sensor 20192. For example, in an embodiment wherein the system 20000 is embodied in a material transfer vehicle, the distance sensor 20192 may be placed in a hopper 20190 which may be relatively hot and steamy. As explained above, this may render the distance sensor 20192 prone to giving false readings. However, the controller 20100 may be configured to determine whether or not the distance sensor is giving a false reading based on input from the second parameter sensor 20400. For example, if the distance sensor 20192 is providing data which indicates the hopper 20190 is full and the second parameter sensor 20400 sends data indicating no or little material is being removed from the hopper 20190, then it may be inferred that the distance sensor 20192 is providing a false reading. This would indicate to an operator, or the controller 20100, that the distance sensor 20192 should be checked or reset in order to ensure it is functioning properly.

In example embodiments the controller 20100 may be used to control an amount of material inside the hopper 20190. For example, in some applications it may be desired to keep a certain level of material inside the hopper 20190 in order to prevent material segregation. In other applications, the controller 20100 may be used to help control a weight of the asphalt inside the hopper 20190 in order to ensure the weight of the system 20000 does not exceed certain limits. For example, as previously described, certain job sites have limitations as to how much a material transfer device may weigh in order to prevent damage to the ground. The controller 20100 may use the data from the distance sensor 20192 and the inclination sensor 20194 to determine how full the hopper 20190 is and thus may calculate how much the material weighs. The controller 20100 may then use this data to control each of the first, second, and third feeders 20160, 20170, and 20180 in order to ensure an amount of material in the hopper remains within an acceptable range. For example, in one embodiment the controller 20100 may turn off certain feeders, for example, feeder 20160, in the event it is determined that too much material is in the hopper 20190. In another embodiment, the controller 20100 may simply reduce the speed at which one or more of the feeders operate. For example, in this latter embodiment, if the controller 20100 determines a weight limit associated with the hopper 20190 is being approached, the controller 20100 may reduce a speed of the first feeder 20160 or increase a speed of the second and third feeders 20170 and 20180.

Example embodiments of the invention have been described in an illustrative manner. It is to be understood that the terminology that has been used is intended to be in the nature of words of description rather than of limitation. Many modifications and variations of example embodiments are possible in light of the above teachings. Therefore, within the scope of the appended claims, the present invention may be practiced otherwise than as specifically described.

What we claim is:

1. A system comprising:

a first feeder configured to move asphalt;

a hopper configured to receive the asphalt from the first feeder;

a second feeder configured to move the asphalt out of the hopper;

at least one non-contact sensor configured to sense the asphalt in the hopper;

a controller configured to receive a signal from the at least one non-contact sensor and control the first feeder and the second feeder to control the amount of asphalt in the hopper based on set parameters of minimum and maximum amount limits; and an inclination sensor configured to sense an inclination of the hopper about at least two axes and send a signal to the controller, wherein the controller is configured to calculate the level of asphalt within the hopper based at least partly on the signal from the inclination sensor and determine an amount of asphalt within the hopper based on the signal from the at least one non-contact sensor.

2. The system of claim 1, further comprising:

a visual indicator observable by ground based personnel, the visual indicator configured to output a recognizable reading of the amount of asphalt in the hopper.

3. The system of claim 1, wherein:

determining the amount of asphalt within the hopper determines the weight of asphalt inside the hopper and the minimum amount limit is a minimum weight limit of asphalt in the hopper and the maximum amount limit is a maximum weight limit of asphalt in the hopper.

4. The system of claim 3, wherein:

the first feeder includes a first motor and the second feeder includes a second motor and controlling the first and second feeders includes controlling speeds of the first and second motors.

5. The system of claim 3, further comprising:

a first parameter sensor configured to sense a first parameter associated with the first feeder and transmit a first signal to the controller; and a second parameter sensor configured to sense a second parameter associated with the second feeder and transmit a second signal to the controller.

6. The system of claim 5, wherein:

the first parameter and second parameter is at least one of pressure and amperage.

7. The system of claim 6, wherein:

at least one of pressure and amperage is inputted to the controller and is used to determine if asphalt is being added to or removed from the hopper.

8. The system of claim 7, wherein:

the controller is further configured to determine an amount of material in the hopper based on the amount of material added or removed from the internal storage hopper.

9. The system of claim 1, wherein the first feeder, the hopper, the second feeder, and the at least one non-contact sensor are part of a same material transfer vehicle.

10. A method comprising:

moving asphalt to a hopper using a first feeder and moving the asphalt out of the hopper using a second feeder;

sensing asphalt within the hopper using at least one non-contact sensor;

sending a signal from the at least one non-contact sensor to a controller;

controlling the first and second feeders based on output from the at least one non-contact sensor to keep the amount of asphalt in the hopper between a minimum amount and a maximum amount;

sensing an inclination of the hopper about at least two axes using an inclination sensor and sending a signal to the controller; and calculating a level of asphalt within the hopper based at least partly on the signal from the inclination sensor.

11. The method of claim 10, wherein controlling the first and second feeders includes controlling the first and second feeders and the minimum amount is a minimum weight amount and the maximum amount is a maximum weight amount.

12. The method of claim 11, wherein:

wherein controlling the first and second feeders includes controlling speeds of the first and second feeders by controlling speeds of a first motor and a second motor.

13. The method of claim 11, further comprising:

sensing a first parameter associated with the first feeder and transmitting a first signal to the controller; and sensing a second parameter associated with the second feeder and transmitting a second signal to the controller.

14. The method of claim 13, wherein:

the first parameter and second parameter is at least one of pressure and amperage.

15. The method of claim 14, further comprising:

determining if asphalt is being added to or removed from the internal storage hopper.

16. The system of claim 15, wherein:

determining an amount of material in the hopper is based on the amount of material added or removed from the hopper.

* * * * *